US012006811B2

(12) United States Patent
Papouras et al.

(10) Patent No.: US 12,006,811 B2
(45) Date of Patent: Jun. 11, 2024

(54) GEOSTEERING PROCESS DOCUMENTING SYSTEM AND METHODS

(71) Applicant: Nabors Drilling Technologies USA, Inc., Houston, TX (US)

(72) Inventors: Christopher Papouras, Houston, TX (US); Christopher Viens, Houston, TX (US); Walter A. Lombard, V, Tomball, TX (US)

(73) Assignee: NABORS DRILLING TECHNOLOGIES USA, INC., Houston, TX (US)

( * ) Notice: Subject to any disclaimer, the term of this patent is extended or adjusted under 35 U.S.C. 154(b) by 806 days.

(21) Appl. No.: 15/719,984

(22) Filed: Sep. 29, 2017

(65) Prior Publication Data

US 2019/0100985 A1 Apr. 4, 2019

(51) Int. Cl.

| | |
|---|---|
| ***E21B 44/00*** | (2006.01) |
| ***E21B 7/04*** | (2006.01) |
| ***E21B 47/12*** | (2012.01) |
| ***E21B 49/00*** | (2006.01) |

(52) U.S. Cl.

CPC ..... *E21B 44/00* (2013.01); *E21B 7/04* (2013.01); *E21B 47/12* (2013.01); *E21B 49/00* (2013.01)

(58) Field of Classification Search

CPC . E21B 44/00; E21B 49/00; E21B 7/04; E21B 47/12

See application file for complete search history.

(56) References Cited

U.S. PATENT DOCUMENTS

| | | | | |
|---|---|---|---|---|
| 2011/0172976 | A1* | 7/2011 | Budiman | E21B 47/04 703/2 |
| 2014/0291024 | A1* | 10/2014 | Sugiura | E21B 44/005 175/45 |
| 2014/0379133 | A1* | 12/2014 | Toma | E21B 47/024 700/275 |
| 2015/0129306 | A1* | 5/2015 | Coffman | E21B 44/00 175/25 |
| 2016/0024847 | A1* | 1/2016 | Benson | E21B 49/00 175/24 |
| 2016/0053604 | A1* | 2/2016 | Abbassian | E21B 44/00 702/6 |
| 2016/0291575 | A1* | 10/2016 | Moore | E21B 49/08 |
| 2017/0243383 | A1* | 8/2017 | Gillan | E21B 47/024 |
| 2018/0045031 | A1* | 2/2018 | Shaposhnikov | E21B 33/14 |
| 2019/0085680 | A1* | 3/2019 | Maus | E21B 44/00 |

* cited by examiner

*Primary Examiner* — Kyle R Quigley
(74) *Attorney, Agent, or Firm* — Haynes and Boone, LLP

(57) ABSTRACT

Systems and methods of documenting a geosteering process include obtaining measured subterranean formation information while drilling and generating a proposed modification to a well plan based on the obtained information. Information relating to the proposed modification to the well plan may be stored in a drilling control system, and the drilling control system may generate and output a data log including information relating to the proposed modification to the well plan and performance indicators on a stand by stand basis.

19 Claims, 4 Drawing Sheets

300

| 302 STAND | 304 STARTING DEPTH | 306 PLAN USED FOR STAND FROM GEOSTEERING TEAM | 308 CHANGED BY | 310 DEPTH USED IN GEOSTEERING PLAN CHANGED | 312 DEPTH LAG IN GEOSTEERING ANALYSIS (1) | 314 TIME LAG IN GEOSTEERING ANALYSIS (2) | 316 TFA SLIDE (3) | 318 TIME TO GENERATE TFA SLIDE (4) |
|---|---|---|---|---|---|---|---|---|
| 1 | 7,000 | ORIGINAL | | | | | | |
| 2 | 7,090 | ORIGINAL | | | | | | |
| 3 | 7,180 | ORIGINAL | | | | | | |
| 4 | 7,270 | ORIGINAL | | | | | | |
| 5 | 7,360 | 2' ABOVE PLAN | ONSITE DML | 5,000 | (2,360) | 1:30 HOURS | 30 DEG. 30' | 1:00 |
| 6 | 7,450 | 2' ABOVE PLAN | | | | | | |
| 7 | 7,540 | 5' ABOVE PLAN | NBR GEO TEAM | 6,000 | (1,540) | 1:00 HOURS | 25 DEG. 40' | 1:00 |
| 8 | 7,630 | 5' ABOVE PLAN | | | | | | |
| 9 | 7,720 | 5' ABOVE PLAN | | | | | | |

(1) THE DEPTH LAG IN GEOSTEERING ANALYSIS DOCUMENTS THE DEPTH OF DATA AVAILABLE IN THE GEOSTEERING MODEL THAT ESTABLISHED THE NEW PLAN (2) THE TIME LAG IN GEOSTEERING ANALYSIS DOCUMENTS THE TIME LAG IN THAT DIFFERENCE IN DEPTH ABOVE. A ZERO DEPTH LAG WOULD RESULT IN A ZERO TIME LAG VALUE (3) THE TFA AND SLIDE ARE THE IMPACT OF THE PLAN CHANGE. IT REPRESENTS HOW THE SYSTEM REACTED TO A NEW PLAN (4) THE TIME TO GENERATE TFA AND SLIDE IS A KPI TO CHECK THE IMPACT OF THE PLAN, AND HOW LONG IT MIGHT BE TAKING THE CREW TO REACT TO THE NEW PLAN

Fig. 3

GEOSTEERING PROCESS DOCUMENTING SYSTEM AND METHODS

TECHNICAL FIELD

The present disclosure is directed to systems, devices, and methods for documenting a drilling process. More specifically, the present disclosure is directed to systems, devices, and methods for documenting a drilling process by documenting in a central location data and information relating to GEO steering and implementations of a well plan.

BACKGROUND OF THE DISCLOSURE

Geosteering is a process of using data obtained while drilling a well to modify the planned well path. Prior to drilling, all available geological and geophysical data is used to estimate subterranean formations and develop a well plan. As drilling proceeds, drilling rigs may perform downhole surveys to obtain additional subterranean information. As this data is received and processed, the model used to develop the original well plan may be modified. The modified model may then be used to modify the well plan. The modification may then be passed to a designated recipient who passes the instructions on to a directional drilling provider.

However, the process has many shortcomings. For example, the process of moving data obtained from the well into a geosteering system is cumbersome. It often requires a user to obtain the data from the well, and then manually enter the data into the geosteering system. With the data in the geosteering system, a geosteering provider analyzes the data, making subjective determinations and decisions. The geosteering provider may then take his or her analysis in any number of several formats, and may pass this analysis, which may include adjustments and changes to the original well plan, to the rig command center using verbal instructions and/or handwritten notes. A driller at the rig then manually converts the verbal instructions or handwritten notes into instructions for drilling, and makes changes to the drilling system to attempt to execute the instructions from the geosteering provider.

A shortcoming of the process is that there is little visibility on the process, decisions, and instructions. As such, there can also be little accountability for the geosteering provider, the driller, and others who may be involved in the process. In addition, since a rig may drill up to 300 feet per hour, lags can be significant. For example, the geosteering provider may not render analysis until the drilling rig has progressed hundreds or perhaps thousands of feet beyond the location where the original well data was collected. In addition, supervisors have very little insight into the changes in the plan and how and when they were executed at the rig. Therefore, a need exists for a documenting system and methods that provide additional insight relating to the well plan and adjustments to the well plan made during the day geosteering process.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

FIG. 3 is an illustration of an example data log output from the drilling apparatus according to one or more aspects of the present disclosure.

DETAILED DESCRIPTION

Figure 1:
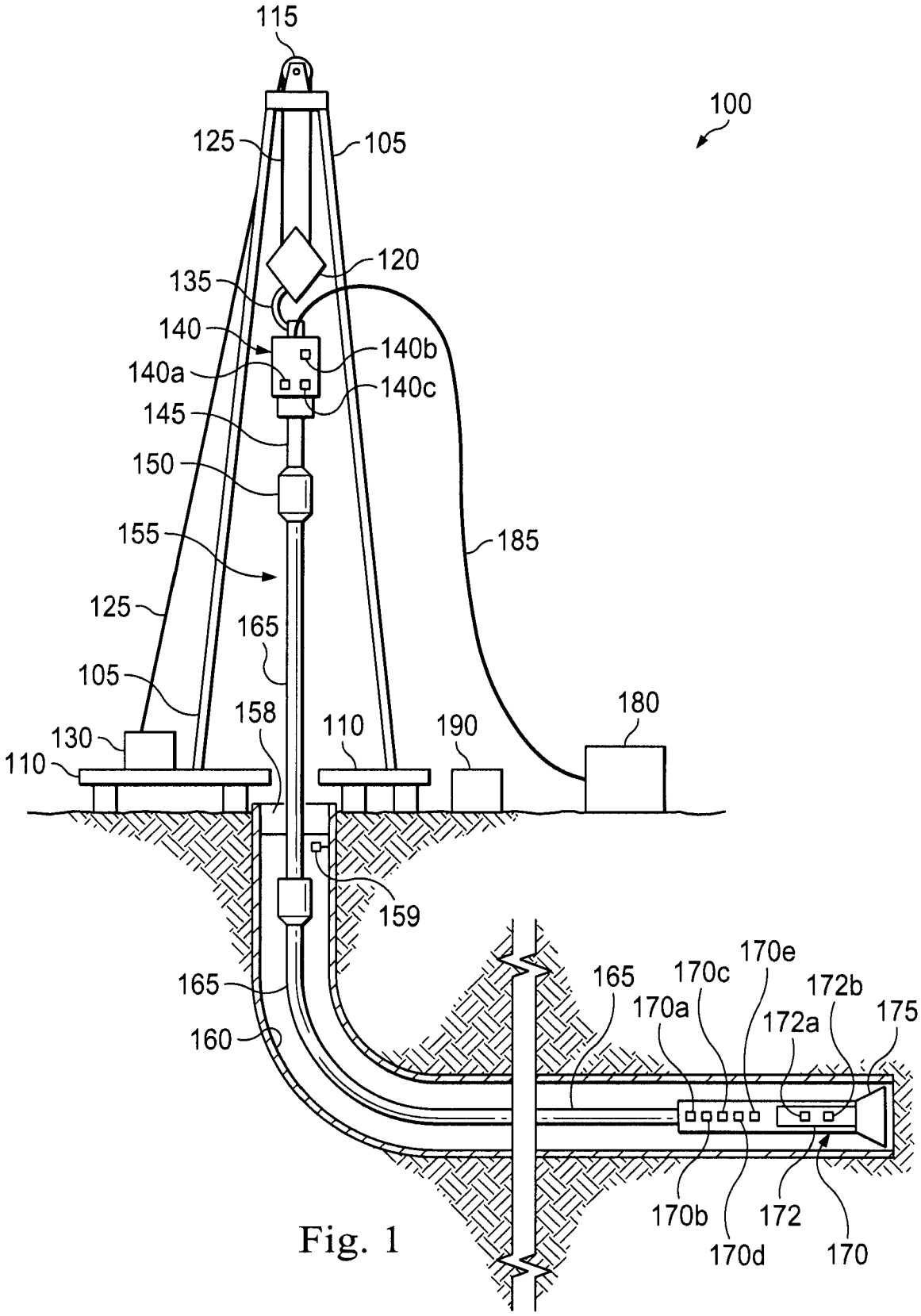
FIG. 1 is a schematic of an exemplary drilling apparatus according to one or more aspects of the present disclosure.

It is to be understood that the following disclosure provides many different implementations, or examples, for implementing different features of various implementations. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various implementations and/or configurations discussed.

The present disclosure is directed to systems, devices, and methods for documenting a geosteering process in a manner that provides a clearer picture of adjustments made to a well plan. The systems, devices, and methods may include generating a data log identifying indicators, time or depth stamps, responsible parties, data, and analysis obtained through the geosteering process. In some implementations, the data log may be suitable to be analyzed by a well operator to better understand and learn from decisions made by particular individuals or entities and the outcome of decisions made.

The systems and methods disclosed herein generate and output the data log of data, timing, and decision-making occurring during a geosteered drilling process. In particular, the systems and methods provide a level of tracking and accountability not seen in prior art systems. For example, the systems and methods create a complete log of data available during the decision-making, the decision made, and when and how new plans were incorporated into the drilling process. This log of data provides a well operator with the clear indication of any time lags that occur between steps of the geosteering process, such as, obtaining data, analyzing data, developing a modified well plan, communicating the well plan, and executing the well plan at the drilling rig. Some implementations of the log also identify and report how any modified or new well plan is carried out or executed by the drilling crew. Accordingly, the data log may provide a well operator with information to evaluate software, workflows, capabilities, and responsiveness of various members involved in the drilling process. In some implementations, the data log may include information gathered stand by stand and may include, the source and depth of data used by a geosteering technician at the time a new plan is created. For example, the drilling rig may be currently drilling at 12,000 feet, but the geosteering technician may have only received data for up to 10,000 feet. These time lags and distance lags may be important for the geosteering technician to be able to provide the best adjustments and changes to the well plan. In addition, the data log may include information relating to the new or modified well plan created by the geosteering technician. The well plan may be recorded in its original format. Likewise, the drilling instructions created by the new plan also may be recorded.

FIG. 1 illustrates a schematic view of an apparatus 100 demonstrating one or more aspects of the present disclosure. The apparatus 100 is or includes a land-based drilling rig. However, one or more aspects of the present disclosure are applicable or readily adaptable to any type of drilling rig, such as jack-up rigs, semisubmersibles, drill ships, coil tubing rigs, well service rigs adapted for drilling and/or re-entry operations, and casing drilling rigs, among others.

The apparatus 100 includes a mast 105 supporting lifting gear above a rig floor 110. The lifting gear includes a crown block 115 and a traveling block 120. The crown block 115 is coupled at or near the top of the mast 105, and the traveling block 120 hangs from the crown block 115 by a drilling line 125. One end of the drilling line 125 extends from the lifting gear to drawworks 130, which is configured to reel in and out the drilling line 125 to cause the traveling block 120 to be lowered and raised relative to the rig floor 110. The other end of the drilling line 125, known as a dead line anchor, is anchored to a fixed position, possibly near the drawworks 130 or elsewhere on the rig.

A hook 135 is attached to the bottom of the traveling block 120. A rotary system, such as a top drive 140 is suspended from the hook 135. A quill 145 extending from the top drive 140 is attached to a saver sub 150, which is attached to a drill string 155 suspended within a wellbore 160. Alternatively, the quill 145 may be attached to the drill string 155 directly. The term "quill" as used herein is not limited to a component which directly extends from the top drive, or which is otherwise conventionally referred to as a quill. For example, within the scope of the present disclosure, the "quill" may additionally or alternatively include a main shaft, a drive shaft, an output shaft, and/or another component which transfers torque, position, and/or rotation from the top drive or other rotary driving element to the drill string, at least indirectly. Nonetheless, albeit merely for the sake of clarity and conciseness, these components may be collectively referred to herein as the "quill."

The drill string 155 may include interconnected sections of drill pipe 165, a bottom hole assembly (BHA) 170, and a drill bit 175. In some implementations, the drill string 155 includes stands of interconnected sections of drill pipe 165. These stands may include two, three, four, or other numbers of sections of drill pipe 165. The sections of drill pipe 165 may be attached together by being threaded together. The drill string 155 may be assembled before, during, and after operations on the drilling rig. For example, the drill string 155 may have stands added to it during a drilling operation as well as tripping in operations, while stands are removed from the drill string 155 during tripping out operations. The stands may be independently assembled (for example at the surface) and added or removed one at a time from the drill string 155.

The BHA 170 may include stabilizers, drill collars, and/or measurement while drilling (MWD) or wireline conveyed instruments, among other components. In some implementations, the BHA 170 includes a MWD survey tool. As will be discussed below, the MWD survey tool may be configured to perform surveys along the length of the wellbore and transmit this information to a control system for analysis.

For the purpose of slide drilling, the drill string may include a down hole motor with a bent housing or other bent component, operable to create an off-center departure of the bit from the center line of the wellbore. The direction of this departure in a plane normal to the wellbore is referred to as the toolface angle or toolface. The drill bit 175, which may also be referred to herein as a "tool," or a "toolface," may be connected to the bottom of the BHA 170 or otherwise attached to the drill string 155. For purposes of rotary steered drilling, the drill string may include a rotary steerable motor operable to drive the rotary steerable motor using pads on the outside of the motor, by bending a main shaft running through the motor, or using other rotary steering systems and methods. One or more pumps 180 may deliver drilling fluid to the drill string 155 through a hose or other conduit, which may be connected to the top drive 140. In some implementations, the one or more pumps 180 include a mud pump.

The down hole MWD or wireline conveyed instruments may be configured for the evaluation of physical properties such as pressure, temperature, gamma radiation count, torque, weight-on-bit (WOB), vibration, inclination, azimuth, toolface orientation in three-dimensional space, and/or other down hole parameters. These measurements may be made down hole, stored in memory, such as solid-state memory, for some period of time, and downloaded from the instrument(s) when at the surface and/or transmitted in real-time and/or in delayed time to the surface. Data transmission methods may include, for example, digitally encoding data and transmitting the encoded data to the surface, possibly as pressure pulses in the drilling fluid or mud system, acoustic transmission through the drill string 155, electronic transmission through a wireline or wired pipe, transmission as electromagnetic pulses, among other methods. In some implementations, survey data, including any of the evaluations of physical properties as discussed above, is transmitted regularly to the control system throughout the various operations of the drilling rig. For example, during a drilling operation, a survey instrument may transmit survey data from a most recent survey as soon as it is performed. The MWD sensors or detectors and/or other portions of the BHA 170 may have the ability to store measurements for later retrieval via wireline and/or when the BHA 170 is tripped out of the wellbore 160. In some implementations, the BHA 170 includes a memory for storing these measurements.

In an exemplary implementation, the apparatus 100 may also include a rotating blow-out preventer (BOP) 158 that may assist when the wellbore 160 is being drilled utilizing under-balanced or managed-pressure drilling methods. The apparatus 100 may also include a surface casing annular pressure sensor 159 configured to detect the pressure in an annulus defined between, for example, the wellbore 160 (or casing therein) and the drill string 155.

In the exemplary implementation depicted in FIG. 1, the top drive 140 is utilized to impart rotary motion to the drill string 155. However, aspects of the present disclosure are also applicable or readily adaptable to implementations utilizing other drive systems, such as a power swivel, a rotary table, a coiled tubing unit, a down hole motor, and/or a conventional rotary rig, among others.

The apparatus 100 also includes a control system 190. The control system 190 may include at least a processor, a memory, and a communication device that is capable of outputting a geosteering process data log. The memory may include a cache memory (e.g., a cache memory of the processor), random access memory (RAM), magnetoresistive RAM (MRAM), read-only memory (ROM), programmable read-only memory (PROM), erasable programmable read only memory (EPROM), electrically erasable programmable read only memory (EEPROM), flash memory, solid state memory device, hard disk drives, other forms of volatile and non-volatile memory, or a combination of different types of memory. In some implementations, the memory may include a non-transitory computer-readable medium. The memory may store instructions. The instructions may include instructions that, when executed by the processor, cause the processor to perform operations described herein with reference to the control system 190 in connection with implementations of the present disclosure. The terms "instructions" and "code" may include any type of computer-readable statement(s). For example, the terms "instructions" and "code" may refer to one or more programs, routines, sub-routines, functions, procedures, etc. "Instructions" and "code" may include a single computer-readable statement or many computer-readable statements.

The processor of the control system 190 may have various features as a specific-type processor. For example, these may include a central processing unit (CPU), a digital signal processor (DSP), an application-specific integrated circuit (ASIC), a controller, a field programmable gate array (FPGA) device, another hardware device, a firmware device, or any combination thereof configured to perform the operations described herein with reference to the control system 190 as shown in FIG. 1 above. The processor may also be implemented as a combination of computing devices, e.g., a combination of a DSP and a microprocessor, a plurality of microprocessors, one or more microprocessors in conjunction with a DSP core, or any other such configuration. The processor may access the memory and execute instruction in the memory.

The control system 190 may be configured to control or assist in the control of one or more components of the apparatus 100. For example, the control system 190 may be configured to transmit operational control signals to the drawworks 130, the top drive 140, the BHA 170 and/or the one or more pumps 180. In some implementations, the control system 190 may be a stand-alone component. The control system 190 may be disposed in any location on the apparatus 100. Depending on the implementation, the control system 190 may be installed near the mast 105 and/or other components of the apparatus 100. In an exemplary implementation, the control system 190 includes one or more systems located in a control room in communication with the apparatus 100, such as the general purpose shelter often referred to as the "doghouse" serving as a combination tool shed, office, communications center, and general meeting place. In other implementations, the control system 190 is disposed remotely from the drilling rig. The control system 190 may be configured to transmit the operational control signals to the drawworks 130, the top drive 140, the BHA 170, and/or the one or more pumps 180 via wired or wireless transmission devices which, for the sake of clarity, are not depicted in FIG. 1.

Figure 2:
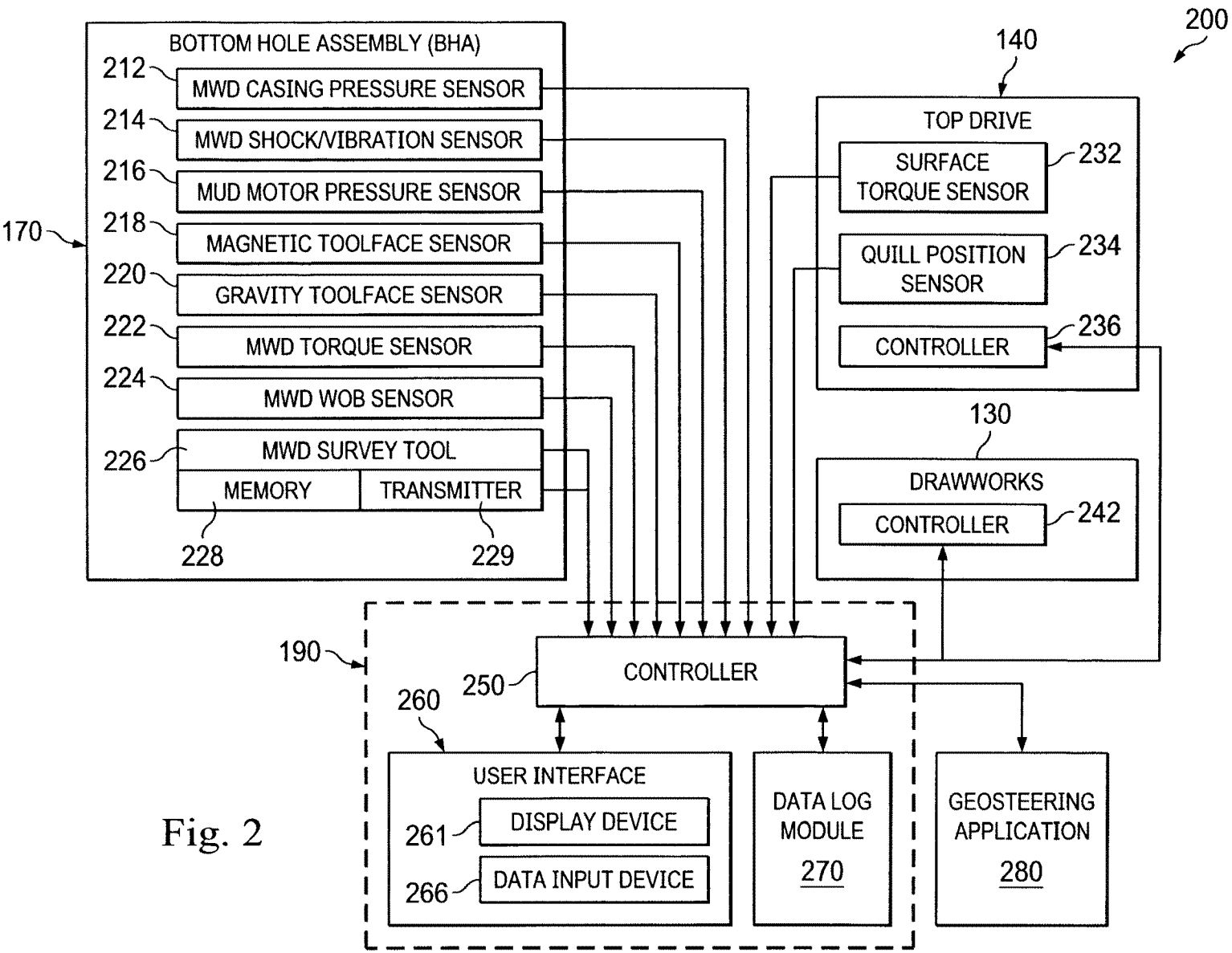
FIG. 2 is a schematic of an exemplary sensor and control system according to one or more aspects of the present disclosure.

The control system 190 may also be configured to communicate prompts, status information, sensor readings, survey results, and other information to an operator, for example, on a user interface such as user interface 260 of FIG. 2. The control system 190 may communicate via wired or wireless communication channels.

It is noted that the meaning of the word "detecting," in the context of the present disclosure, may include detecting, sensing, measuring, calculating, and/or otherwise obtaining data. Similarly, the meaning of the word "detect" in the context of the present disclosure may include detect, sense, measure, calculate, and/or otherwise obtain data.

The control system 190 is also configured to receive electronic signals via wired or wireless transmission devices (also not shown in FIG. 1) from a variety of sensors included in the apparatus 100, where each sensor is configured to detect an operational characteristic or parameter. For example, the control system 190 may include a data acquisition module for receiving readings from the various sensors on the drilling rig. The control system 190 may also be configured to manipulate and display data, such as on a display device.

Depending on the implementation, the apparatus 100 may include a down hole annular pressure sensor **170*a* coupled to or otherwise associated with the BHA 170. The down hole annular pressure sensor 170*a* may be configured to detect a pressure value or range in an annulus shaped region defined between the external surface of the BHA 170 and the internal diameter of the wellbore 160, which may also be referred to as the casing pressure, down hole casing pressure, MWD casing pressure, or down hole annular pressure. Measurements from the down hole annular pressure sensor 170*a*** may include both static annular pressure (pumps off) and active annular pressure (pumps on).

The apparatus 100 may additionally or alternatively include a shock/vibration sensor **170*b* that is configured to detect shock and/or vibration in the BHA 170. The apparatus 100 may additionally or alternatively include a mud motor pressure sensor 172*a* that may be configured to detect a pressure differential value or range across one or more motors 172 of the BHA 170. The one or more motors 172 may each be or include a positive displacement drilling motor that uses hydraulic power of the drilling fluid to drive the drill bit 175, also known as a mud motor. One or more torque sensors 172*b* may also be included in the BHA 170 for sending data to the control system 190 that is indicative of the torque applied to the drill bit 175 by the one or more motors 172. In some implementations, the shock/vibration sensor 170*b* may be used to determine when the drill string 155 is at rest and a survey may be performed. For example, the shock/vibration sensor 170*b* may determine that the drill string 155 is at rest when there is no motion because the system is stopped while a new stand is being added to the drill string 155**. At this time, a survey may be automatically performed to take advantage of the period of inactivity on the drilling rig.

The apparatus 100 may additionally or alternatively include a toolface sensor **170*c* configured to detect the current toolface orientation. In some implementations, the toolface sensor 170*c* may be or include a conventional or future-developed magnetic toolface sensor which detects toolface orientation relative to magnetic north. Alternatively or additionally, the toolface sensor 170*c* may be or include a conventional or future-developed gravity toolface sensor which detects toolface orientation relative to the Earth's gravitational field. The toolface sensor 170*c* may also, or alternatively, be or include a conventional or future-developed gyro sensor. The apparatus 100 may additionally or alternatively include a weight on bit (WOB) sensor 170*d* integral to the BHA 170 and configured to detect WOB at or near the BHA 170**.

The apparatus 100 may additionally or alternatively include a MWD survey tool **170*e* at or near the BHA 170. In some implementations, the MWD survey tool 170*e* includes any of the sensors 170*a*-170*d* as well as combinations of these sensors. The MWD survey tool 170*e* may be configured to perform surveys along length of a wellbore, such as during drilling and tripping operations. The data from these surveys may be transmitted by the MWD survey tool 170*e* to the control system 190 through various telemetry methods, such as electromagnetic (EM) pulses or mud pulses. Additionally or alternatively, the data from the surveys may be stored within the MWD survey tool 170*e* or an associated memory. In this case, the survey data may be downloaded to the control system 190 when the MWD survey tool 170***e* is removed from the wellbore or at a maintenance facility at a later time. In wired systems, the MWD survey tool 170*e* may communicate at any point with the control system 190, including during drilling or other operations. The MWD survey tool 170*e* is discussed further below with reference to FIG. 2.

The apparatus 100 may additionally or alternatively include a torque sensor 140*a* coupled to or otherwise associated with the top drive 140. The torque sensor 140*a* may alternatively be located in or associated with the BHA 170. The torque sensor 140*a* may be configured to detect a value or range of the torsion of the quill 145 and/or the drill string 155 (e.g., in response to operational forces acting on the drill string). The top drive 140 may additionally or alternatively include or otherwise be associated with a speed sensor 140*b* configured to detect a value or range of the rotational speed of the quill 145.

The top drive 140, drawworks 130, crown or traveling block, drilling line or dead line anchor may additionally or alternatively include or otherwise be associated with a WOB sensor 140*c* (WOB calculated from a hook load sensor that may be based on active and static hook load) (e.g., one or more sensors installed somewhere in the load path mechanisms to detect and calculate WOB, which may vary from rig to rig) different from the WOB sensor 170*d*. The WOB sensor 140*c* may be configured to detect a WOB value or range, where such detection may be performed at the top drive 140, drawworks 130, or other component of the apparatus 100.

The detection performed by the sensors described herein may be performed once, continuously, periodically, and/or at random intervals. The detection may be manually triggered by an operator or other person accessing a human-machine interface (HMI), or automatically triggered by, for example, a triggering characteristic or parameter satisfying a predetermined condition (e.g., expiration of a time period, drilling progress reaching a predetermined depth, drill bit usage reaching a predetermined amount, etc.). Such sensors and/or other detection devices may include one or more interfaces which may be local at the well/rig site or located at another, remote location with a network link to the system.

FIG. 2 illustrates a block diagram of a sensor and control system 200 according to one or more aspects of the present disclosure. The sensor and control system 200 includes many of the same features and sensors described with reference to FIG. 1, in addition to additional detail and components of the drilling rig system. Accordingly, in some implementations, the sensor and control system 200 may form a part of the drilling apparatus 100. In other implementations, only a portion of the sensor and control system 200 may form a part of the drilling apparatus 100. In such implementations, other portions of the sensor and control system 200 may be disposed separate from or remote from the drilling apparatus 100.

The sensor and control system 200 may include the control system 190 in communication with the bottom hole assembly (BHA) 170, the top drive 140, and the drawworks 130. Additional controlled components, including pumps, blowout preventers, or other components are not included in FIG. 2, but may also form a part of the sensor and control system 200.

The control system 190 may include a controller 250, a user interface 260, and a data log module 270. The controller 250 may comprise a processor and memory, and may be any of the processors and memories described above with reference to the control system 190. The user interface 260 and the controller 250 may be discrete components that are interconnected via wired or wireless devices. Alternatively, the user interface 260 and the controller 250 may be integral components of the control system 190, as indicated by the dashed lines in FIG. 2.

The user interface 260 may include a data input device 266 for user input of one or more pre-established well plans, geosteering adjustments to a well plan, toolface set points, and other information. The user interface 260 may also include devices or methods for data input of other set points, limits, and other input data. The data input device 266 may be used to manipulate and view data received by the controller 250 or other portion of the control system 190. In some implementations, the data input device 266 is connected to the display device 261 and may be used to select and display data thereon. The data input device 266 may include a keypad, voice-recognition apparatus, dial, button, switch, slide selector, toggle, joystick, mouse, data base and/or other conventional or future-developed data input device. The data input device 266 may support data input from local and/or remote locations. Alternatively, or additionally, the data input device 266 may include devices for user-selection of predetermined toolface set point values or ranges, steering settings, well plan modification settings, such as via one or more drop-down menus, for example. The toolface set point data may also or alternatively be selected by the controller 250 via the execution of one or more database look-up procedures. In general, the data input device 266 and/or other components within the scope of the present disclosure support operation and/or monitoring from stations on the rig site as well as one or more remote locations with a communications link to the system, network, local area network (LAN), wide area network (WAN), Internet, satellite-link, and/or radio, among other devices.

The user interface 260 may also include a display device 261 arranged to present data, status information, sensor results, prompts, measurements and calculations, drilling rig visualizations, information relating to well plan adjustments, geosteering information, as well as any other information. The user interface 260 may visually present information to the user in visual form, such as textual, graphic, video, or other form, or may present information to the user in audio or other sensory form. In some implementations, the display device 261 may be arranged to display a geosteering data log to a user. This geosteering data log may be generated by the data log module 270 and may include a data log of data, timing, and decision-making occurring during a geosteering process. In some implementations, the display device 261 is a computer monitor, an LCD or LED display, table, touch screen, or other display device. The user interface 260 may include one or more selectable icons or buttons to allow an operator to access information and control various systems of the drilling rig. In some implementations, the display device 261 is configured to present information related to survey results on the drilling rig. The survey results as well as other measurement data, data from the sensor or survey tool, may be displayed graphically on the display device 261, such as on a chart or by using various colors, patterns, symbols, images, figures, or patterns. In addition to showing results of surveys performed during a drilling operation, the display device 261 may be configured to display original well plan information, as well as any modified well plan information.

In some implementations, the sensor and control system 200 may include a number of sensors. Although a specific number of sensors are shown in FIG. 2, the sensor and control system 200 may include more or fewer sensors than those disclosed. Furthermore, some implementations of the drilling system may include additional sensors not specifically described herein.

Still with reference to FIG. 2, the BHA 170 may include a MWD casing pressure sensor 212 that is configured to detect an annular pressure value or range at or near the MWD portion of the BHA 170, and that may be substantially similar to the down hole annular pressure sensor 170*a* shown in FIG. 1. The casing pressure data detected via the MWD casing pressure sensor 212 may be sent via electronic signal to the controller 250 via wired or wireless transmission.

The BHA 170 may also include a MWD shock/vibration sensor 214 that is configured to detect shock and/or vibration in the MWD portion of the BHA 170, and that may be substantially similar to the shock/vibration sensor 170*b* shown in FIG. 1. The shock/vibration data detected via the MWD shock/vibration sensor 214 may be sent via electronic signal to the controller 250 via wired or wireless transmission.

The BHA 170 may also include a mud motor pressure sensor 216 that is configured to detect a pressure differential value or range across the mud motor of the BHA 170, and that may be substantially similar to the mud motor pressure sensor 172*a* shown in FIG. 1. The pressure differential data detected via the mud motor pressure sensor 216 may be sent via electronic signal to the controller 250 via wired or wireless transmission. The mud motor pressure may be alternatively or additionally calculated, detected, or otherwise determined at the surface, such as by calculating the difference between the surface standpipe pressure just off-bottom and pressure once the bit touches bottom and starts drilling and experiencing torque.

The BHA 170 may also include a magnetic toolface sensor 218 and a gravity toolface sensor 220 that are cooperatively configured to detect the current toolface, and that collectively may be substantially similar to the toolface sensor 170*c* shown in FIG. 1. The magnetic toolface sensor 218 may be or include a conventional or future-developed magnetic toolface sensor which detects toolface orientation relative to magnetic north. The gravity toolface sensor 220 may be or include a conventional or future-developed gravity toolface sensor which detects toolface orientation relative to the Earth's gravitational field. In an exemplary implementation, the magnetic toolface sensor 218 may detect the current toolface when the end of the wellbore is less than about 7° from vertical, and the gravity toolface sensor 220 may detect the current toolface when the end of the wellbore is greater than about 7° from vertical. However, other toolface sensors may also be utilized within the scope of the present disclosure, including non-magnetic toolface sensors and non-gravitational inclination sensors. In any case, the toolface orientation detected via the one or more toolface sensors (e.g., magnetic toolface sensor 218 and/or gravity toolface sensor 220) may be sent via electronic signal to the controller 250 via wired or wireless transmission.

The BHA 170 may also include a MWD torque sensor 222 that is configured to detect a value or range of values for torque applied to the bit by the motor(s) of the BHA 170, and that may be substantially similar to the torque sensor 172*b* shown in FIG. 1. The torque data detected via the MWD torque sensor 222 may be sent via electronic signal to the controller 250 via wired or wireless transmission.

The BHA 170 may also include a MWD WOB sensor 224 that is configured to detect a value or range of values for WOB at or near the BHA 170, and that may be substantially similar to the WOB sensor 170*d* shown in FIG. 1. The WOB data detected via the MWD WOB sensor 224 may be sent via electronic signal to the controller 250 via wired or wireless transmission.

The BHA 170 may also include a MWD survey tool 226. The MWD survey tool 226 may be similar to the MWD survey tool 170*e* of FIG. 1. The MWD survey tool 226 may be configured to perform surveys at intervals along the wellbore, such as during drilling and tripping operations. The MWD survey tool 226 may include one or more gamma ray sensors that detect gamma data. The data from these surveys may be transmitted by the MWD survey tool 226 to the controller 250 through various telemetry methods, such as electromagnetic (EM) pulses or mud pulses. In other implementations, survey data is collected and stored by the MWD survey tool in an associated memory 228. This data may be uploaded to the controller 250 at a later time, such as when the MWD survey tool 226 is removed from the wellbore or during maintenance. Some implementations use alternative data gathering sensors or obtain information from other sources. For example, the BHA 170 may include sensors for making additional measurements, including, for example without limitation, azimuthal gamma data, neutron density, porosity, and resistivity of surrounding formations. In some implementations, such information may be obtained from third parties or may be measured by systems other than the BHA 170.

The BHA 170 may include a memory 228 and a transmitter 229. In some implementations, the memory 228 and transmitter 229 are integral parts of the MWD survey tool 226, while in other implementations, the memory 228 and transmitter 229 are separate and distinct modules. The memory 228 may be any type of memory device, such as a cache memory (e.g., a cache memory of the processor), random access memory (RAM), magnetoresistive RAM (MRAM), read-only memory (ROM), programmable read-only memory (PROM), erasable programmable read only memory (EPROM), electrically erasable programmable read only memory (EEPROM), flash memory, solid state memory device, hard disk drives, or other forms of volatile and non-volatile memory. The memory 228 may be configured to store readings and measurements for some period of time. In some implementations, the memory 228 is configured to store the results of surveys performed by the MWD survey tool 226 for some period of time, such as the time between drilling connections, or until the memory 228 may be downloaded after a tripping out operation.

The transmitter 229 may be any type of device to transmit data from the BHA 170 to the controller 250, and may include and EM transmitter and/or a mud pulse transmitter. In some implementations, the MWD survey tool 226 is configured to transmit survey results in real-time to the surface through the transmitter 229. In other implementations, the MWD survey tool 226 is configured to store survey results in the memory 228 for a period of time, access the survey results from the memory 228, and transmit the results to the controller 250 through the transmitter 229.

The drawworks 130 may include a controller 242 and/or other devices for controlling feed-out and/or feed-in of a drilling line (such as the drilling line 125 shown in FIG. 1). Such control may include rotational control of the drawworks (in versus out) to control the height or position of the hook, and may also include control of the rate the hook ascends or descends.

The top drive 140 may include a surface torque sensor 232 that is configured to detect a value or range of the reactive torsion of the quill or drill string, much the same as the torque sensor 140*a* shown in FIG. 1 and or other sensors including those described with reference to FIG. 1. The top drive 140 also includes a quill position sensor 234 that is configured to detect a value or range of the rotational position of the quill, such as relative to true north or another stationary reference. The surface torsion and quill position data detected via the surface torque sensor 232 and the quill position sensor 234, respectively, may be sent via electronic signal to the controller 250 via wired or wireless transmission. The top drive 140 also includes a controller 236 and/or other devices for controlling the rotational position, speed, and direction of the quill or other drill string component coupled to the top drive 140 (such as the quill 145 shown in FIG. 1).

The controller 250 may be configured to receive information or data relating to one or more of the above-described parameters from the user interface 260, the BHA 170 (including the MWD survey tool 226), the drawworks 130, and/or the top drive 140. In some implementations, the parameters are transmitted to the controller 250 by one or more data channels. In some implementations, each data channel may carry data or information relating to a particular sensor.

In some implementations, the controller 250 may also be configured to determine a current toolface orientation, to determine a position of the BHA relative to a well plan, to receive inputs to modify a well plan, receive inputs to modify a direction of drilling, or other steering inputs to provide information to the data log module 270, to communicate with a separate geosteering application 280, to receive communications from the geosteering application 280, and perform other processes. The controller 250 may be further configured to generate a control signal, such as via intelligent adaptive control, and provide the control signal to the top drive 140 and/or the drawworks 130 to adjust and/or maintain the toolface orientation in order to carry out instructions to follow a well plan, or to deviate from a well plan.

The controller 250 may also provide one or more signals to the drive system 230 and/or the drawworks 240 to increase or decrease WOB and/or quill position, such as may be required to accurately "steer" the drilling operation.

The data log module 270 may be configured to receive information from the controller relating to different elements of a geosteering process. In some implementations, the data log module 270 may receive information relating to an original well plan from the controller 250. This information may be stored in the data log module 270 or may be stored in the controller 250. For example, the data log module 270 may receive information from the controller 250 relating to MWD surveys including information obtained or detected by the MWD survey tool 226, information relating to a current well plan, a modified well plan, and information received from a geosteering application suggesting modifications to the well plan. The data log module 270 may be configured to document stand by stand information for the well plan including information relating to the plan used for a particular stand, the depth at which a particular stand is introduced, the lag in depth or in time of a change based on detected survey information, steps taken to implement a plan, and other information. Accordingly, the data log module 270 may be configured to receive and store information that enables it to generate a complete log of data available during the decision-making processes, the decision made processes, and when and how new plans are incorporated into the drilling process.

The data log module 270 may also be particularly programmed or configured to generate and output a data log for the drilling process. An example of the data log is shown in FIG. 3, and is described in further detail herein. In some implementations, the data log may be output on the display device 261 of the user interface 260. In other implementations, the data log may be output at a location remote from the apparatus 100. For example, the data log module 270 may generate a data log and send the data log to a location remote from the drilling site that may be accessible by drilling rig supervisors or others.

Although a particular arrangement of the control system 190 is shown in FIG. 2, it should be understood that other arrangements for carrying out the processes described herein may be implemented. For example, in some implementations, the user interface 260 may directly communicate with the data log module 270. Likewise the geosteering application may communicate directly with the data log module 270. In some implementations, the data log module 270 is disposed separate from the control system 190. Accordingly, information may be conveyed over a network or data lines to provide information to the data log module 270. In some implementations, the data log module 270 is disposed remote from the apparatus and may be under the direct control of an offsite drilling supervisor. Other arrangements are also contemplated.

The geosteering application 280 may be configured to assess survey information obtained from the controller 250 and provide instruction or data feedback based upon the obtained survey data. The geosteering application 280 may be independent of and separate from the control system 190. In some implementations, the geosteering application 280 may be remote from the apparatus 100 and configured to receive and process information obtained from the geological surveys taken by the BHA 170. Based upon the information, geosteering technicians such as geologists, engineers, or others may review a well plan, and suggest changes or modifications to the well plan based upon the survey information relating to the geological formation. The modified well plan may be communicated back from the geosteering application 280 to the controller 250. The controller 250 may then communicate information to the data log module 270 that may be used in the generation of the data log. In some examples, the data log may include information relating to the modified well plan including the recommended change to the original (or prior) well plan, when the recommendation was made, the lag time between when the survey was taken and when the recommendation was made, who made the recommendation to modify the well plan, whether the recommendation was carried out, how was carried out, and when it was carried out. Other information may also be included. The geosteering application may or may not form a part of the control system 190.

As indicated above, in some implementations, the controller 250 may be in communication with the data log module 270 while in other implementations, the geosteering application may communicate directly with the data log module 270 which may form or may not form a part of the control system 190.

FIG. 3 shows an example of a data log 300 output from a data log module 270 in a table format. The data log 300 includes a plurality of geosteering key performance indicators (KPIs) that may include one or more parameters, measurements, or points of data that may be used to draw conclusions regarding a particular well being drilled by the drilling apparatus 100.

In the example shown, the data log 300 includes a plurality of columns and rows with each column representing a particular type of information, and each row designating a particular stand at which the column information was applied. In this example, the column 302 identifies a particular stand by number, column 304 identifies the starting depth for the stand, column 306 identifies the plan used for the stand, column 308 identifies the individual or entity recommending a change to the well plan, column 310 identifies the depth used in geosteering plan change, column 312 identifies the depth lag in the geosteering analysis, column 314 identifies the time lag in the geosteering analysis, column 316 identifies the TFA slide which includes the impact on the actual location of the BHA 170, and column 318 identifies the time to generate the TFA slide.

The stand number in column 302 and the starting depth and column 304 may be numerically tallied based upon the activity of the apparatus 100. For example, the data log module 270 may receive information from the controller 250 indicating each time a new stand is added. The data log module 270 may respond by generating a row of information relating to the particular stand. The starting depth in column 304 may be measured or calculated based on the number of stands and the average stand height. In the example shown, each stand is 90 feet long and therefore the starting depth increments by 90 feet per stand. In some implementations, each stand is measured during the drilling process, and the starting depth may account for deviations and stand lengths. For example, a stand that is 87 feet will be detected as the top drive 140 travels and advances the drill string. The controller 250 may then communicate the actual stand length to the data log module 270, which would generate the data log with the correct stand length and hole depth.

The column 306 identifies the well plan used during drilling of each stand. In this example, stands 1-4 were driven using the original well plan. At stand 5, at a starting depth of 7,360 feet, a modified plan is presented. In this instance, the modified plan is to drill two feet above the original well plan. Two stands later, at stand 7, the plan again changes to be five feet above the original well plan. The data log module 270 is configured to track the plan used for each stand that is received from the geosteering team. In this implementation, column 306 identifies not only a plan being used, but how that plan deviates from the original well plan. As such, users analyzing the data log 300 can easily know how the plan was modified. In some implementations, the modified plan is received from the geosteering application 280. The well plan instructions may be communicated directly to the controller 250, which may then communicate instructions to the data log module 270. In other implementations, the geosteering application 280 may communicate the plan instructions directly to the data log module 270. In some implementations, the geosteering application 280 may communicate the instructions to a user, such as a driller on the drilling apparatus 100. The user may then enter the plan instructions using the data input device 266. This may then be communicated by the controller to the data log module 270.

The column 308 identifies the person or entity that changed or modified the well plan. This information may be generated automatically based on information sent from the geosteering application 280. In the implementation shown, the well plan modification at stand 5 was made by the on-site dynamic mud logger (DML), which is a software application. The well plan modification at stand 7 is made by the Nabors geosteering team (NBR Geo Team), which may include one or more geosteering technicians such as geologists and/or engineers, for example. Because of this, the data log 300 includes not only when the plan was changed, and how the plan was changed, but the person or entity that requested the plan change. This historical information may improve accountability by identifying the responsible entity.

The column 310 identifies the depth of the survey used to initiate a geosteering plan change. For example, the well plan was modified at stand 5 to drill two feet above the original well plan. This decision however, was based upon survey data obtained at a well depth of 5000 feet as indicated in column 310. At stand 7, the well plan was again modified to drill five feet above the original well plan. This decision was based upon survey data obtained at a well depth of 6000 feet as indicated in column 310.

The column 312 indicates the depth lag in the geosteering analysis. This depth lag is calculated and displayed on the data log by subtracting the depth of the survey from the starting depth of the stand when the well plan was modified. In the example shown, stand 5 has a starting depth of 7360 feet and the well plan was modified based on information obtained at 5000 feet, resulting in a depth lag of 2360 feet. The depth lag at stand 7 is over 800 feet less than the depth lag at stand 5. The depth lag at stand 7 is only 1540 feet. In a typical drilling scenario, a smaller depth lag is desirable to ensure modifications to the well plan are based on relevant geological information.

The column 314 shows the time lag in the geosteering analysis. In the example shown, the time lag is calculated by taking the time difference between when the survey being relied upon was taken and when a well plan change based on that survey was implemented. In this example, the modified well plan at stand 5 was introduced 1 hour 30 minutes after the survey. At stand 7, the modified well plan was introduced 1 hour after the relevant survey. This timed or calculated KPI may be indicative of the responsiveness of the geosteering team and or other individuals in the decision-making process. Obviously, in a typical drilling scenario, a smaller time lag is more desirable.

The column 316 shows the total flow area (TFA) and slide length which represent the impact of the modification to the original well plan, or the manner in which the driller executes the modified well plan. For example, to implement the modified well plan at stand 5, the driller sets the TFA at 30° and slides 30 feet. To implement the modified well plan at stand 7, the driller sets the TFA at 25° and slides 40 feet. Accordingly, the data log 300 shows the actual implementation to execute the well plan and at which stand the implementation was introduced to the well plan. Accordingly, users can determine the actual steps taken by a driller to carry out the modified well plan.

The column 318 shows the time to generate TFA and the slide. This KPI is a time measurement of how long it takes the drilling crew to react to the new plan. By showing the time to generate the TFA and the slide, drilling supervisors may have increased knowledge as to the responsiveness of the driller in response to receiving new instruction. This may provide additional accountability and transparency to the driller activities. In this implementation, the amount of time may be calculated or documented from the time the modified well plan instructions are received to the time that the TFA and slide are initiated. Some implementations have additional KPIs that may be documented or calculated in order to provide transparency to the drilling process.

Figure 4:
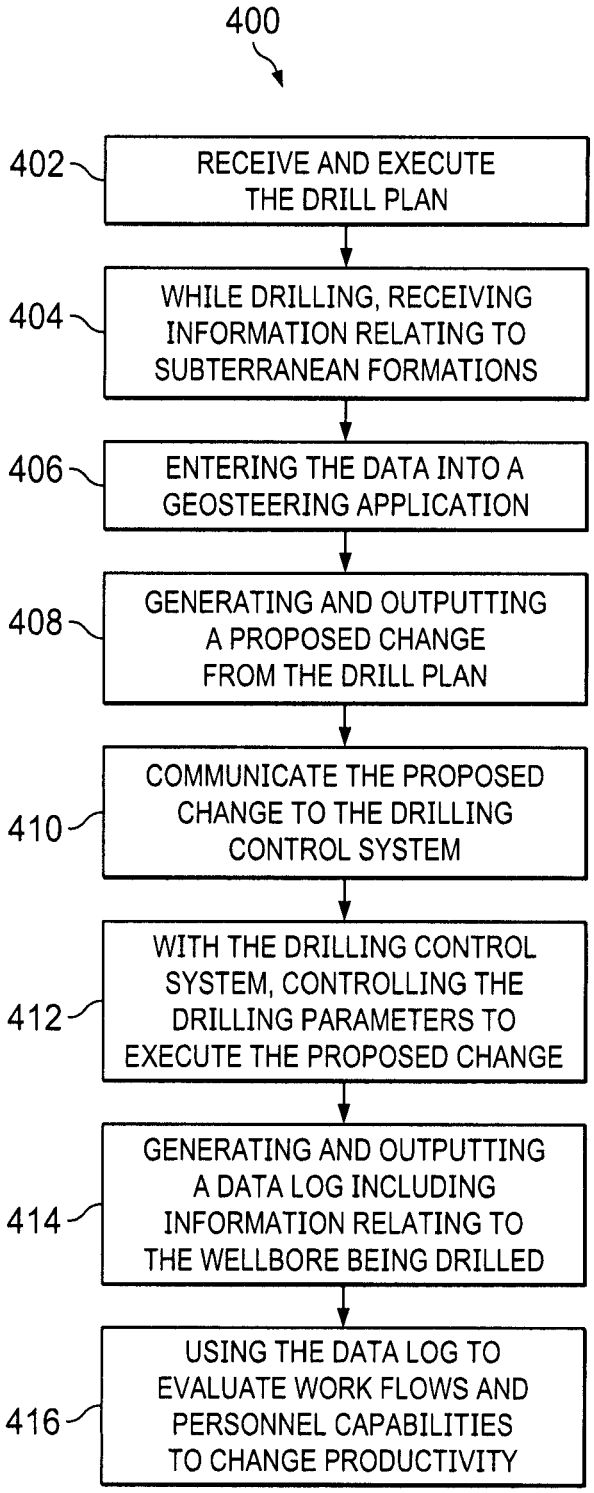
FIG. 4 is a flow chart diagram of a method of tracking and documenting a drilling process with geosteering according to one or more aspects of the present disclosure.

FIG. 4 is a flowchart showing a method 400 of generating a data log with the data log module for a drilling apparatus. The method 400 may be carried out by the apparatus 100 including the control system 190 and in particular, the controller 250 and the data log module 270.

At 402, the control system 190 receives and executes a well plan. In some implementations, the well plan is an original well plan created prior to beginning a well drilling process with the apparatus 100. In other implementations, the well plan is a modified well plan to be carried out by the apparatus 100. The well plan may be communicated to and portions of the well plan may be stored in the data log module. For example, the data log module may include information relating to the number of stands. In some implementations, the original well plan is not communicated in its entirety to the data log module, but instead information relating to the well plan is communicated to the data log module on a stand by stand basis.

At 404, the control system 190 receives information relating to subterranean formations. In some implementations, this information may be received by the MWD survey tool associated with the BHA. In some implementations, the information may be detected using any of the sensors described herein, including gamma sensors with environmental monitoring capability or other sensors that may gather, for example, azimuthal gamma information, neutron density, porosity, and resistivity of surrounding formations. In some implementations, the information may be detected by the BHA each time a stand is introduced to the drill string. In other implementations, the information may be detected at other regular or irregular intervals. The information received may be indicative of geological formations through in which the BHA is disposed. The detected information may be transmitted to the surface using electromagnetic telemetry, mud pulse telemetry, direct transmission through wired pipe, or other methods. In some implementations, the detected information is stored at the BHA and retrieved when the BHA is tripped out for maintenance or for other reasons. In some implementations, the received information relating to the subterranean formations may be stored in the data log module. The stored information may include subterranean information, but may also include timestamps of when the survey data was taken and obtained by the controller 250. In some applications, the information may be gathered from tools separate from the BHA.

At 406, the detected information is entered into a geosteering application. In some implementations the control system 190 may communicate information from the controller to the geosteering application. Depending upon the implementation, the geosteering application may form a portion of the control system 190 or may be a stand-alone application which may process and analyze the data to determine the geological formations of the wellbore. In some implementations, the geosteering application is under the control of a separate and independent geosteering entity that may be contracted for its expertise.

The geosteering application may also include information relating to the current well plan. For example, the geosteering application may have been instrumental in developing the original well plan and therefore may have information therein relating to the original well plan and relating to the best-guessed or expected geological formations. The measured or detected data may be used to more accurately determine the location and types of geological formations through which the BHA passes. Based on this, the geosteering application may take into account the more accurate geological formation information and generate either a new well plan or a modified well plan based off the original well plan.

At 408, the geosteering application may output a proposed change to the original well plan, and at 410, the proposed change may be communicated to the drilling control system. In conventional systems, this proposed change may be delivered to the drilling apparatus 100 via a phone call, a note, an email, or using other transmittal means. In order to generate the desired data log, the output change from the original well plan must be documented. Therefore, in some implementations, the geosteering application may communicate the proposed change to the well plan directly to the control system 190 via the controller 250. In some implementations, the controller 250 may then communicate the modified well plan to the data log module 270. In some implementations the geosteering application 280 may communicate directly to the data log module 270. Depending upon the implementation, the geosteering application 280 may include a timestamp identifying the time the survey was taken and the depth of the survey relied upon to recommend a modification to the well plan. In some implementations, the time and depth may have been recorded prior to sending the information to the geosteering application. The geosteering application 280 may also include information indicating the person or entity recommending the modification to the well plan. This information may be used to establish the data log described herein.

At 412, the control system 190 may be controlled to execute the proposed change to the well plan. The data log module may communicate with the controller in order to document when the proposed change to the well plan was received, and how the driller intends to execute the plan. It may also include information relating to the time taken by a driller after receiving instructions to execute the plan. Executing the proposed change may include inputting instructions to change the TFA and to slide for a certain distance or length of time.

At 414, in response to either a manual request or an automatic trigger, the data log module may generate and output a data log including information relating to the wellbore being drilled. In some implementations, the data log module generates and outputs a data log in real time as the log is developed. In some implementations, this includes a plurality of KPIs indicative of performance of individuals and the system in executing different elements of the drilling process. In some implementations, the data log includes information that may be incrementally included, may be calculated, or may be detected by the geosteering application, the controller, or the data log module. In some examples, the data log includes the information shown in FIG. 3. For example, the data log module may be configured to receive information, store information, and calculate information, such as KPI information relating to the well drilling process. For example, the data log module may be configured to calculate depth lags, time lags, time to implement well plan changes, and other information. The data log module may be configured to detect and store the starting depth for each stand, the well plan used during each stand, who or what entity recommends the changes to the well plan, the depths at which surveys were taken, and the instruction input by an operator to execute a change to the well plan.

At 416, a user may use the data log to evaluate workflows and personnel capabilities to change productivity. In some implementations, productivity may be increased due to increased accountability by individuals with a role in the process of creating a modified well plan and executing the modified well plan. Because the data log includes data, timing, and decision-making, users may be able to evaluate software, workflows, capabilities, and responsiveness of members involved in the drilling process. This may provide additional transparency and accountability to the drilling process.

In view of all of the above and the figures, one of ordinary skill in the art will readily recognize that the present disclosure introduces a method of documenting a geosteering process that includes obtaining, with a measurement-while-drilling (MWD) survey tool, measured subterranean formation data while executing a first well plan stored in a drilling control system; generating a proposed modification to the first well plan based on the measured subterranean formation data; storing the proposed modification in a drilling control system along with the depth and time that the subterranean formation data was obtained; receiving a drilling instruction at the drilling control system to modify the first well plan according to the stored, proposed modification to the first well plan, and drilling according to the proposed modification; and with the drilling control system, automatically generating and outputting a data log indicating: (1) the proposed modification to the well plan, (2) a depth at which the measured subterranean formation data was obtained, and (3) a lag representing a difference in time or hole depth between obtaining the measured subterranean formation data and receiving the drilling instruction at the drilling control system to modify the first well plan.

In some aspects, automatically generating and outputting a data log comprises indicating a time lag representing a difference in time between obtaining the measured subterranean formation data and receiving the drilling instruction to modify the first well plan. In some aspects, automatically generating and outputting a data log comprises showing time to generate a slide after the proposed modification is received at the drilling control system. In some aspects, automatically generating and outputting a data log comprises identifying the person or entity recommending the proposed modification based on the data relating to the subterranean formation. In some aspects, obtaining measured subterranean formation data comprises using gamma data obtained from a gamma sensor on a bottom hole assembly to obtain the data. In some aspects, obtaining measured subterranean formation data comprises using one of telemetry and direct transmission through wired pipe to transmit the data from downhole in a well to the drilling control system. In some aspects, the method includes electronically communicating the proposed modification to the first well plan from a geosteering application to the drilling control system. In some aspects, the method includes automatically outputting the proposed modification from a geosteering application to the drilling control system. In some aspects, automatically generating and outputting a data log includes outputting a slide length and toolface setting. In some aspects, the method includes executing the modified first well plan by directing a RSS (rotary steerable system). In some aspects, automatically generating and outputting a data log comprises arranging the data in columns and rows for viewing by well operators. In some aspects, automatically generating and outputting a data log comprises generating the log with a row for each stand in the drill string.

In additional exemplary aspects, the disclosure is directed to methods of documenting a geosteering process comprising: obtaining with a measurement-while-drilling (MWD) survey tool subterranean formation data while executing a first well plan stored in a drilling control system; entering the subterranean formation data into a geosteering application; outputting from the geosteering application a proposed modification to the well plan being executed based on the entered subterranean formation data; communicating the proposed change from the geosteering application to the drilling control system; and with the drilling control system, automatically generating and outputting a data log indicating: (1) a depth of a wellbore, (2) the well plan used for each stand, (2) an indication of a person or entity who proposed the change to the well plan, (3) a depth at which the subterranean formation data was obtained that was relied upon for the proposed modification, and (4) a time lag representing the difference in time between obtaining the subterranean formation data and receiving the drilling instruction at the drilling control system to modify the first well plan, and (5) a depth lag representing a difference in depth between obtaining the subterranean formation data and receiving a drilling instruction to modify the first well plan.

In some aspects, automatically generating and outputting a data log comprises showing time to generate a slide after the proposed modification is received at the drilling control system. In some aspects, automatically generating and outputting a data log comprises showing an action taken by a driller to implement the proposed modification to the well plan. In some aspects, obtaining measured subterranean formation data comprises using one of telemetry and direct transmission through wired pipe to transmit the data from downhole well to the drilling control system. In some aspects, automatically generating and outputting a data log comprises arranging the data in columns and rows for viewing by well operators.

In additional exemplary aspects, the disclosure is directed to a sensor and control system for generating a data log comprising: a measurement-while-drilling (MWD) survey tool configured to detect subterranean formation data; a geosteering application configured to receive and process the detected data in order to generate a modification to a well plan; a data log module configured to receive and store information relating to: (1) the modification to the well plan, (2) a depth at which the measurement while drilling survey tool detected data that the geosteering application relied upon for the proposed modification, and (3) a lag representing a difference in time or hole depth between obtaining the subterranean formation data and receiving the modification to the well plan, the data log module being configured to generate and output a data log in a table format showing the proposed modification to the well plan, the depth at which the measurement while drilling survey tool detected subterranean formation data, and the lag.

In some aspects, the data log module is configured to calculate and output in the table format (1) a depth lag representing the difference in hole depth between obtaining the subterranean formation data and receiving the modification to the well plan, and (2) a time lag representing the difference in time between obtaining the subterranean formation data and receiving the modification to the well plan. In some aspects, the data log module is configured to output the person or entity that generated the modification to the well plan.

The foregoing outlines features of several implementations so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the implementations introduced herein. One of ordinary skill in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. § 1.72(b) to allow the reader to quickly ascertain the nature of the technical disclosure. It is submitted with the understanding that it will not be used to interpret or limit the scope or meaning of the claims.

Moreover, it is the express intention of the applicant not to invoke 35 U.S.C. § 112(f) for any limitations of any of the claims herein, except for those in which the claim expressly uses the word "means" together with an associated function.

What is claimed is:

1. A method of documenting a geosteering process comprising:

obtaining, with a measurement-while-drilling (MWD) survey tool, measured subterranean formation data while executing a first drill plan stored in a drilling control system;

recording, with the drilling control system, a first time at which the measured subterranean data was obtained from the survey tool;

communicating the measured subterranean formation data directly from the drilling control system to a geosteering application;

while continuing to execute the first drill plan, generating a proposed modification to the first drill plan based on the measured subterranean formation data with the geosteering application;

communicating the proposed modification directly from the geosteering application to the drilling control system including an indication of a person or entity who proposed the modification to the first drill plan;

storing the proposed modification in the drilling control system along with a depth and first time that the subterranean formation data was obtained and along with the indication of the person or entity who proposed the modification to the first drill plan;

receiving a drilling instruction at the drilling control system to modify the first drill plan according to the stored, proposed modification to the first drill plan, and drilling according to the proposed modification;

recording, with the drilling control system, a second time at which the drilling instruction was received;

with the drilling control system, automatically generating and outputting a data log indicating data values for each of: (1) the proposed modification to the first drill plan, (2) the depth at which the measured subterranean formation data was obtained, (3) a time lag representing a difference in time between the first and second times as recorded by the drilling control system along with the first and second times; (4) a depth lag representing a difference in hole depth between the first and second times as recorded by the drilling control system; and (5) the indication of the person or entity who proposed the modification to the first drill plan; and evaluating personnel capabilities to change productivity based on the implementation of the proposed modification to the first drill plan and a responsiveness of the person or entity based on the data values (2)-(4).

2. The method of claim 1, wherein automatically generating and outputting a data log comprises showing time to generate a slide after the proposed modification is received at the drilling control system.

3. The method of claim 1, wherein obtaining measured subterranean formation data comprises using gamma data obtained from a gamma sensor on a bottom hole assembly to obtain the data.

4. The method of claim 1, wherein obtaining measured subterranean formation data comprises using one of telemetry and direct transmission through wired pipe to transmit the data from downhole in a well to the drilling control system.

5. The method of claim 1, comprising electronically communicating the proposed modification to the first drill plan from a geosteering application to the drilling control system.

6. The method of claim 1, comprising automatically outputting the proposed modification from a geosteering application to the drilling control system.

7. The method of claim 1, wherein automatically generating and outputting a data log includes outputting a slide length and toolface setting.

8. The method of claim 1, further comprising executing the modified first drill plan by directing a RSS (rotary steerable system).

9. The method of claim 1, wherein automatically generating and outputting a data log comprises arranging the data in columns and rows for viewing by well operators.

10. The method of claim 1, wherein automatically generating and outputting a data log comprises generating the log with a row for each drill pipe stand in the drill string.

11. A method of documenting a geosteering process comprising:

obtaining with a measurement-while-drilling (MWD) survey tool subterranean formation data while executing a drill plan stored in a drilling control system;

while continuing to execute the drill plan, entering the subterranean formation data into a geosteering application;

outputting from the geosteering application a proposed modification to the drill plan being executed based on the entered subterranean formation data and including an indication of a person or entity who proposed the modification to the drill plan;

automatically communicating the proposed modification from the geosteering application directly to the drilling control system including the indication of the person or entity who proposed the modification to the drill plan; and with the drilling control system, automatically generating and outputting a data log indicating separate numerical entries for each of: (1) a depth of a wellbore, (2) the drill plan used for each drill pipe stand, (3) the indication of the person or entity who proposed the modification to the drill plan, (4) a depth at which the subterranean formation data was obtained that was relied upon for the proposed modification, (5) a time lag representing a difference in time between obtaining the subterranean formation data and receiving a drilling instruction at the drilling control system to modify the drill plan, and (6) a depth lag representing a difference in depth between obtaining the subterranean formation data and receiving the drilling instruction to modify the drill plan, wherein the data log includes at least one drill pipe stand associated with the depth lag; and evaluating personnel capabilities to change productivity based on the implementation of the proposed modification to the drill plan and a responsiveness of the person or entity based on the data values (4)-(6).

12. The method of claim 11, wherein automatically generating and outputting a data log comprises showing time to generate a slide after the proposed modification is received at the drilling control system.

13. The method of claim 11, wherein automatically generating and outputting a data log comprises showing an action taken by a driller to implement the proposed modification to the drill plan.

14. The method of claim 11, wherein obtaining measured subterranean formation data comprises using one of telemetry and direct transmission through wired pipe to transmit the data from downhole well to the drilling control system.

15. The method of claim 11, wherein automatically generating and outputting a data log comprises arranging the data in columns and rows for viewing by well operators.

16. A sensor and control system for generating a data log comprising:

a measurement-while-drilling (MWD) survey tool configured to detect subterranean formation data;

a drilling control system configured to receive the detected data directly from the MWD survey tool;

a geosteering application configured to receive the detected data directly from the drilling control system and process the detected data in order to generate a proposed modification to a drill plan while continuing to execute the drill plan, the geosteering application being configured to communicate the proposed modification directly from the geosteering application to the drilling control system including an indication of a person or entity who proposed the modification to the drill plan; and a data log module configured to receive and store information relating to: (1) the modification to the drill plan, (2) a depth at which the measurement while drilling survey tool detected data that the geosteering application relied upon for the proposed modification, (3) a time lag representing a difference in time between obtaining the subterranean formation data and receiving the modification to the drill plan, (4) a depth lag representing a difference in hole depth between obtaining the subterranean formation data and receiving the modification to the drill plan, (5) the indication of the person or entity who proposed the modification to the drill plan, the data log module being configured to generate and output a data log in a table format showing separate numerical entries for each of the proposed modification to the drill plan, the depth at which the measurement while drilling survey tool detected subterranean formation data, the time lag, the depth lag, and the indication of the person or entity who proposed the modification to the drill plan, wherein each of the separate numerical entries is correlated to at least one drill pipe stand, wherein the data log is used to evaluate personnel capabilities to change productivity based on the implementation of the proposed modification to the drill plan and a responsiveness of the person or entity based on the data values (2)-(4).

17. The sensor and control system of claim 16, wherein the data log module is configured to calculate and output in the table format (1) the depth lag representing the difference in hole depth between obtaining the subterranean formation data and receiving the modification to the drill plan, and (2) the time lag representing the difference in time between obtaining the subterranean formation data and receiving the modification to the drill plan.

18. The sensor and control system of claim 16, wherein the data log module is configured to calculate and output in the table format (1) the drill plan, and (2) a deviation from the drill plan.

19. The sensor and control system of claim 18, wherein the data log module is configured to calculate and output in the table format a total flow area based on the proposed modification to the drill plan.

* * * * *